US005165693A

United States Patent [19]

Handlon, Sr.

[11] Patent Number: 5,165,693

[45] Date of Patent: Nov. 24, 1992

[54] METHOD OF PLAYING A BOWLING CARD GAME

[76] Inventor: Charles J. Handlon, Sr., 2804 Berkley Dr., Rocky Mount, N.C. 27803

[21] Appl. No.: 666,657

[22] Filed: Mar. 8, 1991

[51] Int. Cl.[5] ..... A63F 1/00

[52] U.S. Cl. ..... 273/298

[58] Field of Search ..... 273/298, 240, 244, 259, 273/277, 292, 299-308

[56] References Cited

U.S. PATENT DOCUMENTS

| | | | |
|---|---|---|---|
| 2,138,272 | 11/1938 | Feher | 273/298 |
| 4,241,924 | 12/1980 | Arcara | 273/277 |
| 4,501,426 | 2/1985 | Seitz | 273/277 |
| 4,546,982 | 10/1985 | Gaines | 273/298 |
| 4,793,617 | 12/1988 | Sanon | 273/298 |

OTHER PUBLICATIONS

Scarne's Encyclopedia of Games by John Scarne, Harper & Row, Publishers, 1973, pp. 6-14.

Kellogg's (Tenpin) Bowling Game Using Playing Cards, the Bo-Lyn Company, 1970.

*Primary Examiner*—Benjamin H. Layno

[57] ABSTRACT

The present invention entails a card game for simulating the game of bowling. A deck of cards (30) is provided, with each card having a combination of a word(34) a symbol(36) and a number(32) or a word and a number thereon. Further, the game apparatus is provided with tokens(21) and score pad(20). In playing the present game, cards and tokens are dealt to a plurality of players, after which they are permitted by order of seating, to play cards that are held that are most advantageous to the players accumulated score. A player may also make an exchange of a hand for a new hand by the surrender of a token in accordance with the rules. The player with the highest accumulated score after the completion of ten rounds of play is declared the winner.

1 Claim, 7 Drawing Sheets

METHOD OF PLAYING A BOWLING CARD GAME

BACKGROUND AND FIELD OF INVENTION

Card games are widely played by adults, young adults, teenagers and children. They form a very important part of pastime activities, providing recreation and amusement for many people.

While such games are fun and entertaining, they often go beyond that by being interesting, challenging, stimulating and educational.

This invention relates generally to card games for simulating the game of bowling. More particularly but not by way of limitation, this invention relates to a card game apparatus for simulating a game of bowling and to method of playing such a game apparatus.

U.S. Pat. No. 4,546,982 issued Oct. 15, 1985 to Mary L. Gaines and Charles J. Gaines describes a special deck of cards and scoring apparatus that simulates the game of golf.

According to the disclosure, the golf game is simulated by dealing a hand of cards to each player and by the process of drawing and discarding, each player works to improve their hand in order to gain an advantage over the opponents. The special golf cards are different from those of this invention, but the patent has been cited to illustrate that special decks of cards have been utilized in games heretofore.

U.S. Pat. No. 4,793,616 issued Dec. 27, 1988 to Henry R. Sanon utilizes a plurality of decks of cards to simulate the game of tennis. This also is a different sporting event being simulated and is cited merely to show that the use of cards to simulate sporting games is widespread.

U.S. Pat. No. 4,501,426 issued Feb. 26, 1985 to John R. Seitz illustrates a card game that simulates the game of bowling. It utilizes tokens, a set of special dice, a plurality of bowler cards and a set of strike, spare and split reference boards. The game process requires the rolling of the dice then reference a particular bowler card indicating specific indicia. The game player then references corresponding strike and spare boards which list result indicia representing a score that the bowler would probably obtain based on average performance.

Games where the player must continually reference scoring boards breaks up the flow and inhibits the continuity of the game. Players must stop to shuffle through the reference boards requiring the rest of the players to sit and wait.

Whenever a plurality of reference boards filled with specific indicia are used to indicate score, errors are often made in reference, changing the outcome of the game.

Reference boards with many rows of numbers spread over a wide area are very difficult to read.

Games where dice are thrown and reference boards are used in conjunction with the dice indicia detract from the players control of the game outcome. There is no decision making process, only the chance results of the dice.

In my invention the player holds an exposed hand of cards that can be immediately evaluated and played from. The flow is smooth and consistant.

My invention has the point value clearly marked on each card allowing the player to evaluate the scoring impact immediately.

The method of play of the cards in my invention allows all players to share in the reading and if the player and scorer have difficulity with accuracy, the other players can assist in making corrections immediately.

The method of playing my invention allows for a decision making process at every card played, giving the player control of the game. The draw of replacement cards allows for the excitement of chance to play a part in the game.

SUMMARY AND OBJECTS OF THE INVENTION

The present invention relates to a card game and associated game apparatus. The game apparatus includes a deck of cards with each card having a number value and word or words or a number value word or words and a symbol thereon. During the course of the game a plurality of players each are dealt a series of cards and a number of tokens and in accordance with the game rules of the present invention players are permitted to play a card of value and bonus value that will increase as subsequent cards are played. As will be more fully appreciated from subsequent portions of this disclosure each player can by predetermined agreement, be a part of a team of players whereas the individual game scores are accumulated to reflect a team score.

It is therefore an object of the game of the present invention to provide a game and game apparatus that can be played by individuals of all ages and which is fun, entertaining, interesting, challenging and educational, but which is also stimulating to social interaction by groups of people.

More particularly, it is an object of the present invention to provide a card game wherein each card includes a number or number and symbol value thereon where in the course of the game young children are taught to recognize and appreciate the numbers and symbols forming a part of the game of the present invention.

A further object of the present invention is to provide a card game and game apparatus that is relatively simple to understand, appreciate and play and wherein game components are relatively simple and which can be manufactured relatively inexpensively.

Other objects and advantages of the present invention will become apparent and obvious from a study of the following description and accompanying drawings, which are merely illustrative of the invention.

BRIEF DESCRIPTION OF DRAWINGS

FIG. 3 showing a card having a number value of three and the word pinns; FIG. 4 showing a card having a number value of four and the word pinns; FIG. 5 showing a card having a number value five and the word pinns; FIG. 6 showing a card having a number value six and the word pinns; FIG. 7 showing a card having a number value seven and the word pinns; FIG. 8 showing a card having a number value eight and the word pinns; FIG. 9 showing a card having a number value nine and the word pinns; FIG. 10 showing a card having a number value one and the word pinn; FIG. 11 showing a card having a number value ten a symbol representing a bonus value and the words strike; FIG. 12 showing a card having a number value ten a symbol representing a bonus value and the words spare; FIG. 13 showing a card having a number value zero and the words gutter ball; FIG. 14 showing a card having a number value zero and the word foul; FIG. 15 showing a card having a number value eight and the word split; FIG. 16 showing a card having a number value seven and the word split; FIG. 17 showing a card having a number value six and the word split; FIG. 18 showing a card having a number value zero and the words made a split; FIG. 19 showing the back of a typical card with the word pinns.

CARD GAME AND ASSOCIATED GAME APPARATUS

With further reference to the drawings, the present card game and associated game apparatus is show therein.

Figure 1:
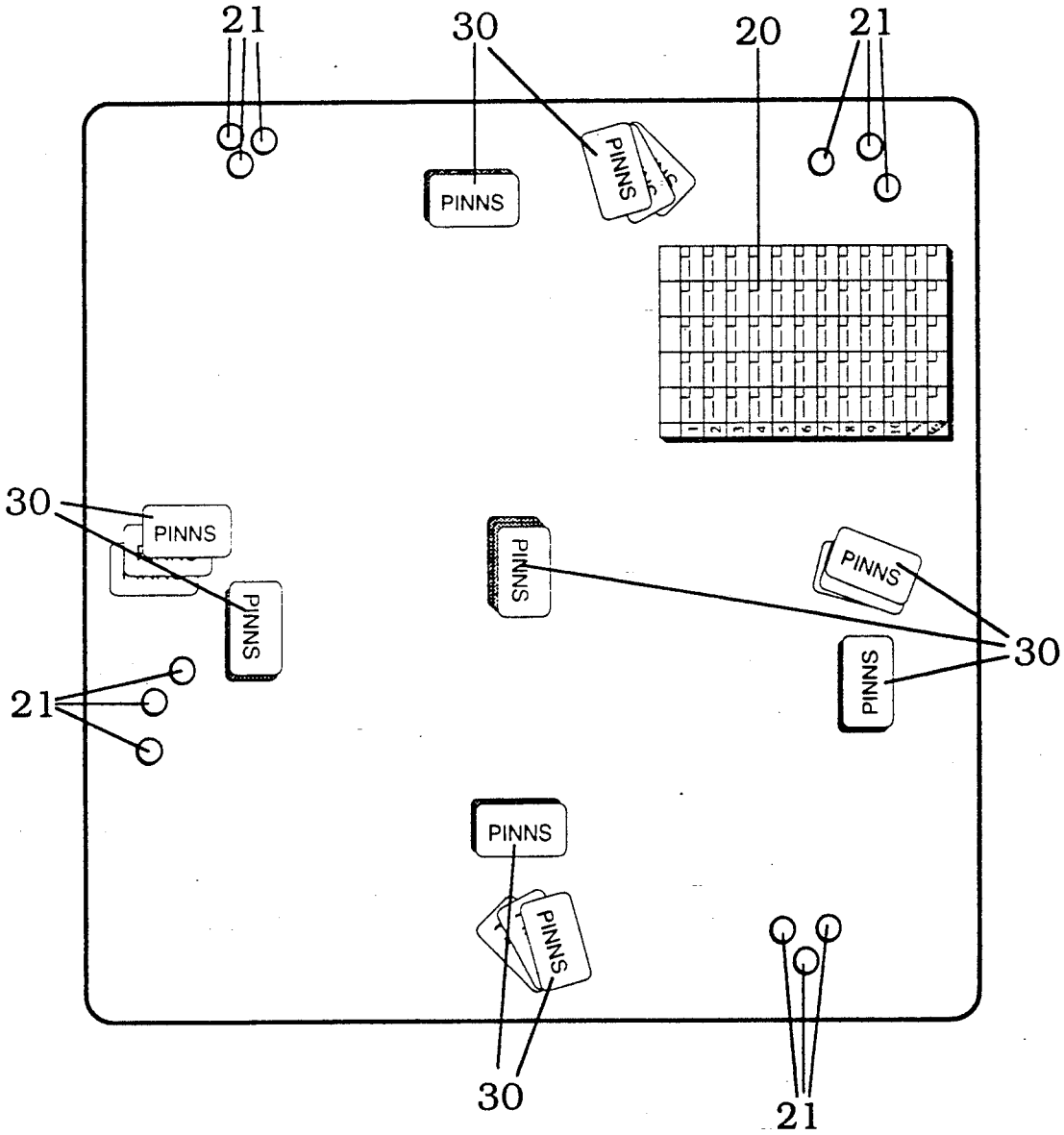
FIG. 1 is a top plan view of the card game and game apparatus of the present invention shown as a lay-out for four players.
Figure 2:
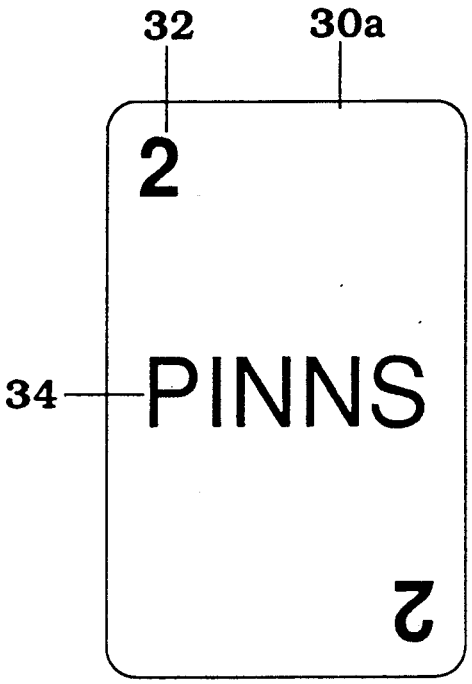
FIGS. 2 through 19 are a sequence of views illustrating a side of each card of the deck of cards forming a part of the game apparatus of the present invention, with FIG. 2 showing a card having a number value of two and the word pinns.

First, with respect to FIG. 1, it is seen that the card game and associated game apparatus includes a deck of cards indicated generally by the numeral 30. In the present embodiment the deck of cards 30 includes two hundred and eight cards. It should be appreciated that the number of cards may vary depending upon the overall design of the game and the rules that are provided therefore.

As seen in FIGS. 2 through 18, each card of the deck of cars 30 includes a side that includes a number value formed on opposite ends of the card. This number value is indicated by the numeral 32. In addition, each card on that same side includes a word or words indicated by the numeral 34. In addition in FIGS. 11 and 12 each card includes on that same side a bonus symbol indicated by the numeral 36.

Viewing the respective cards of the deck in more detail reference is made to FIGS. 2 through 19. Therein each of the cards found in deck 30 are particularly illustrated. In this regard, note in FIG. 2, a card 30*a* is shown. This card includes the number value two and the word pinns. There are twelve cards in the deck that conform to the card 30*a*.

Figure 3:
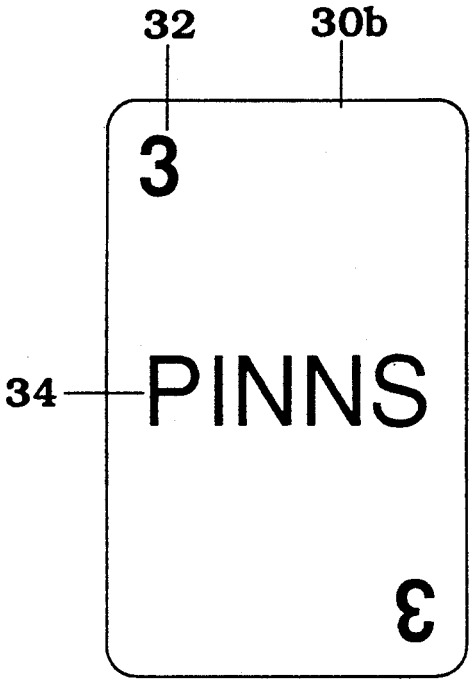
Figure 4:
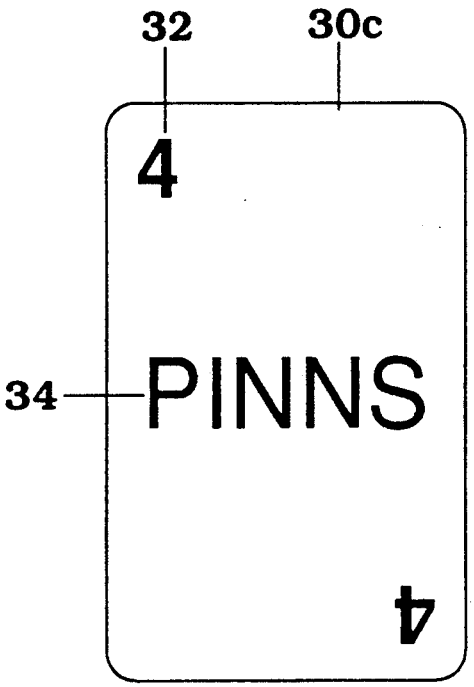
Figure 5:
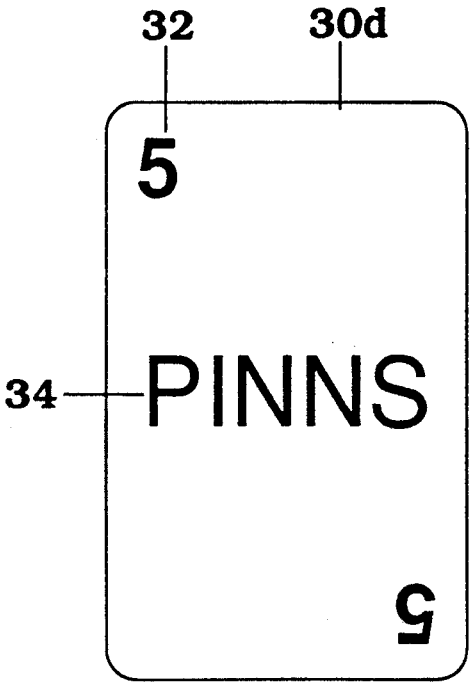
Figure 6:
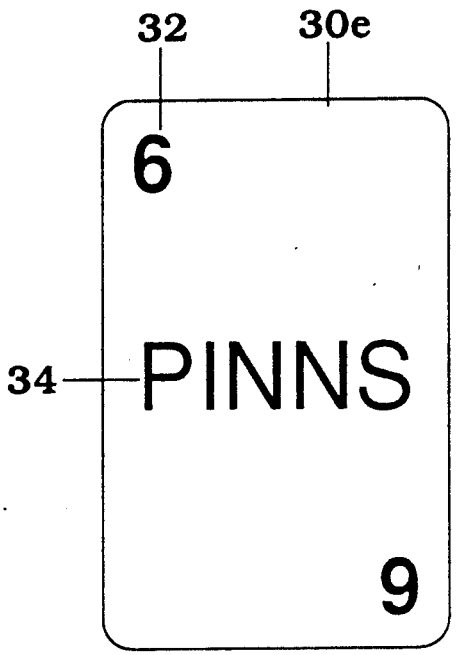
Figure 7:
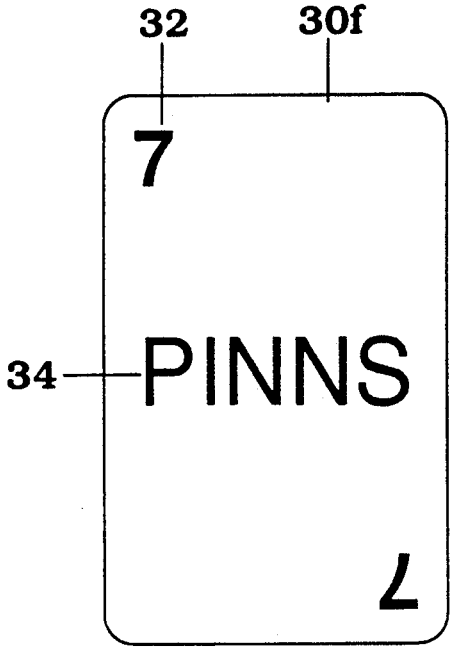
Figure 8:
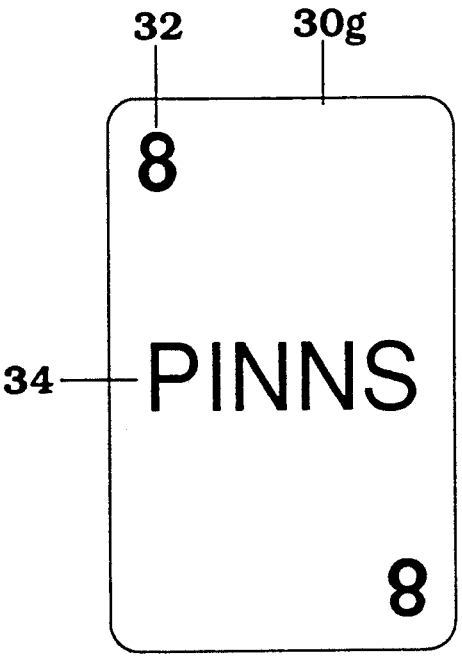
Figure 9:
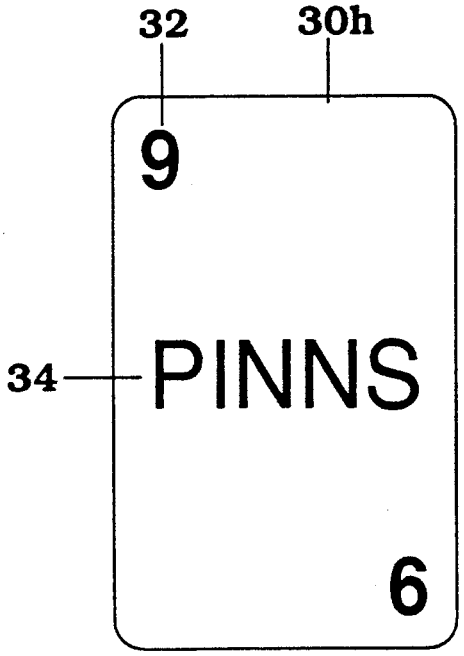

Next in FIG. 3 card 30*b* includes the number value three and the word pinns. There are twelve cards in the deck that conform to the card 30*b*.

In FIGS. 4 through 9 cards 30*c* through 30*h* are each shown. In each case there is a particular number value which is referred to by the numeral 32 and also the word pinns indicated by the numeral 34.

In the card game of the present invention there are eight cards having the number value four; twelve cards having the number value five; eight cards having the number value six; twelve cards having the number value seven; twelve cards having the number value eight and twelve cards having the number value nine.

Figure 10:
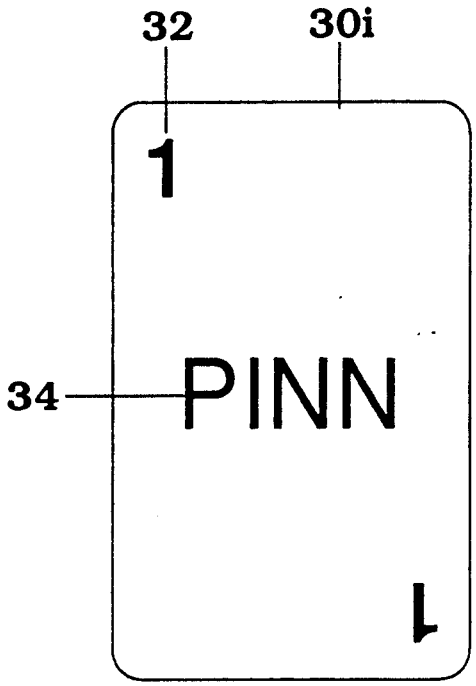

In FIG. 10 card 30*i* includes the number value one indicated by the numeral 32 and the word pinn indicated by the numeral 34. There are twelve cards conforming to card 30*i* in deck 30.

Figure 11:
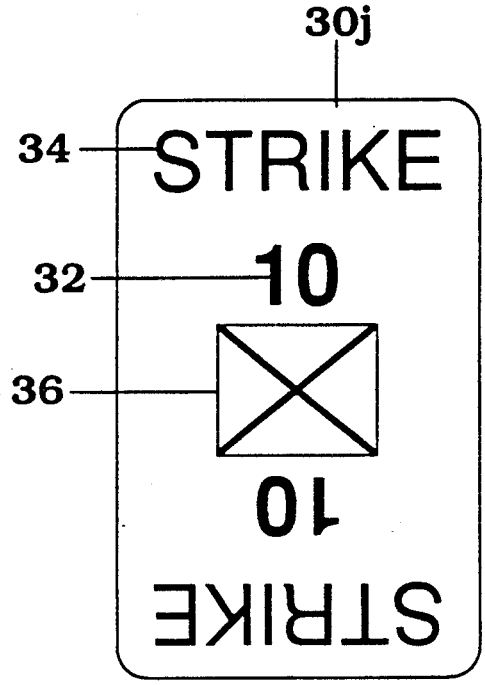

FIG. 11 card 30*j* includes the number value ten indicated by the numeral 32, the words strike indicated by the numeral 34 and the bonus symbol of crossed diagonal lines from corner to corner within a rectangle indicated by the numeral 36. There are forty eight cards in deck 30 that conform to the card 30*j*.

Figure 12:
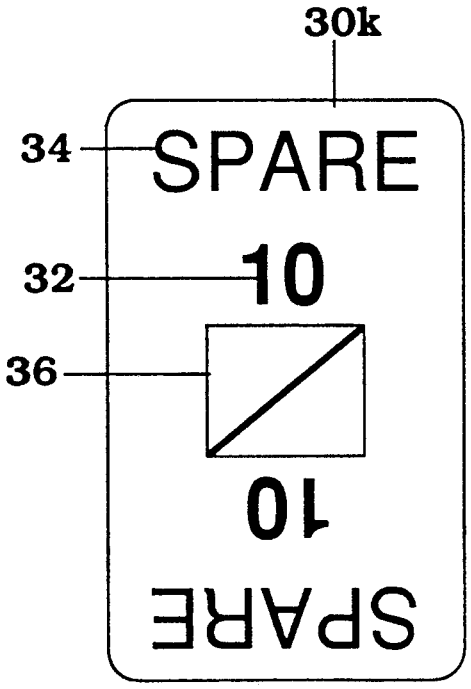

FIG. 12 card 30*k* includes the number value ten indicated by the numeral 32, the words spare indicated by the numeral 34 and the bonus symbol of a rectangle with a diagonal line from the upper right corner to the lower left corner indicated by the numeral 36. There are twenty four cards in deck 30 that conform to card 30*k*.

Figure 13:
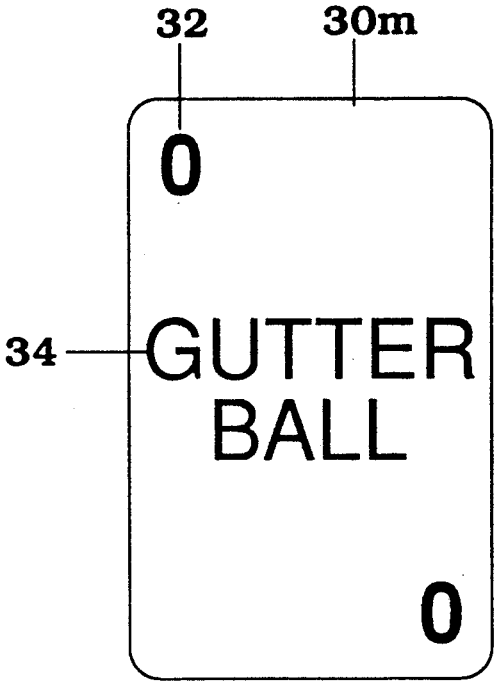
Figure 14:
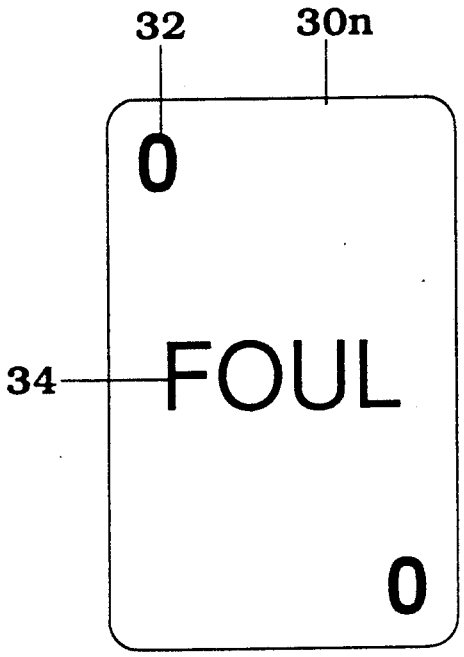

In FIGS. 13 and 14 cards 30*m* and 30*n* respective, each includes the number value zero indicated by the numeral 32 additionally card 30*m* includes the words gutter ball and card 30*n* includes the word foul, each indicated by the numeral 34. There are eight of card 30*m* and four of card 30*n* included in deck 30.

Figure 15:
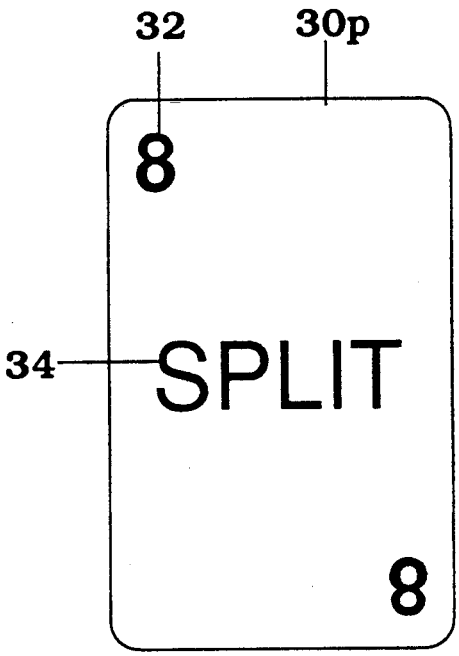
Figure 16:
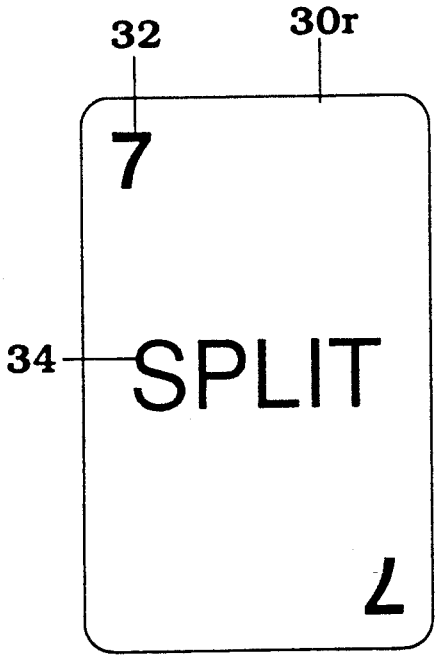
Figure 17:
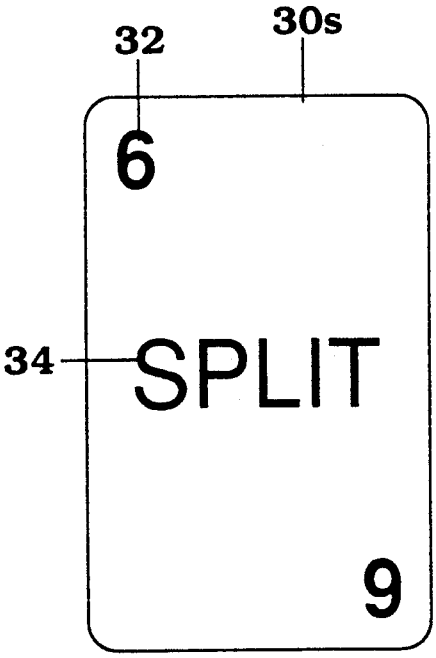

In FIGS. 15, 16 and 17 cards 30*p*, 30*r* and 30*s* the numeral 32 indicates the respective values of eight, seven and six, additionally each has included the word split indicated by the numeral 34. There are four each of cards 30*p*, 30*r* and 30*s* in deck 30.

Figure 18:
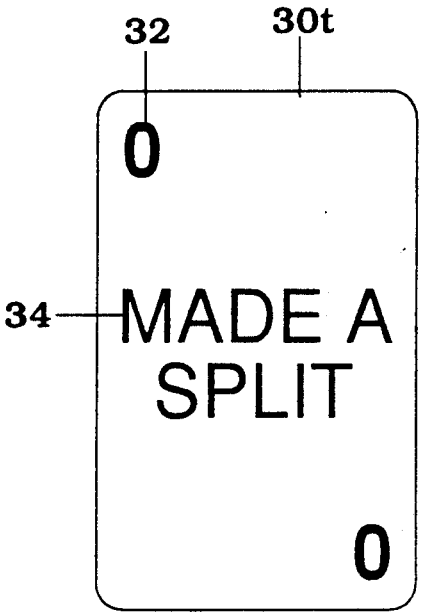

FIG. 18 card 30*t* includes the number value zero indicated by the numeral 32 and the words made a split indicated by the numeral 34. There are twelve cards that conform to card 30*t* in deck 30.

Figure 19:
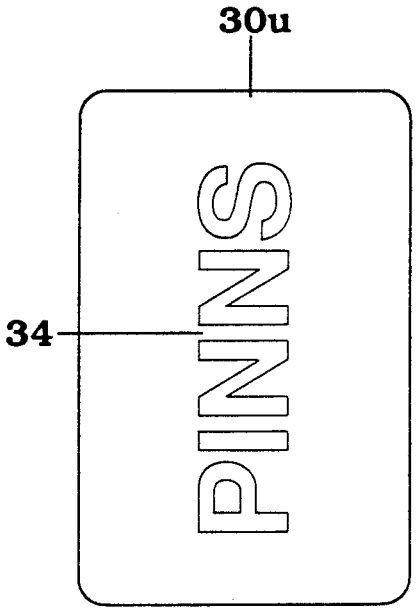
Figure 21:
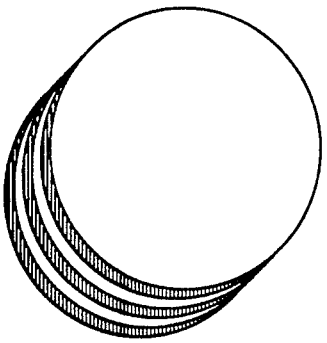
FIG. 21 is a perspective view of the tokens forming a part of the game apparatus of the present invention.
Figure 22:
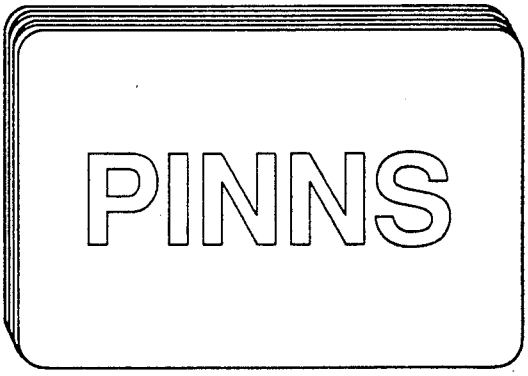
FIG. 22 is a perspective view of the deck of cards forming a part of the game apparatus of the present invention.

In FIG. 19 card 30*u* is a view of the back of a typical card of deck 30. Therefore there are two hundred eight cards with the word pinns on the back side indicated by numeral 32 included in deck 30.

Certain cards when played are awarded a bonus value as will be understood from subsequent portions of this disclosure. The present invention includes a scorepad of specific design indicated in FIG. 1 by numeral 20 to facilitate the ease of bonus scoring.

Figure 20:
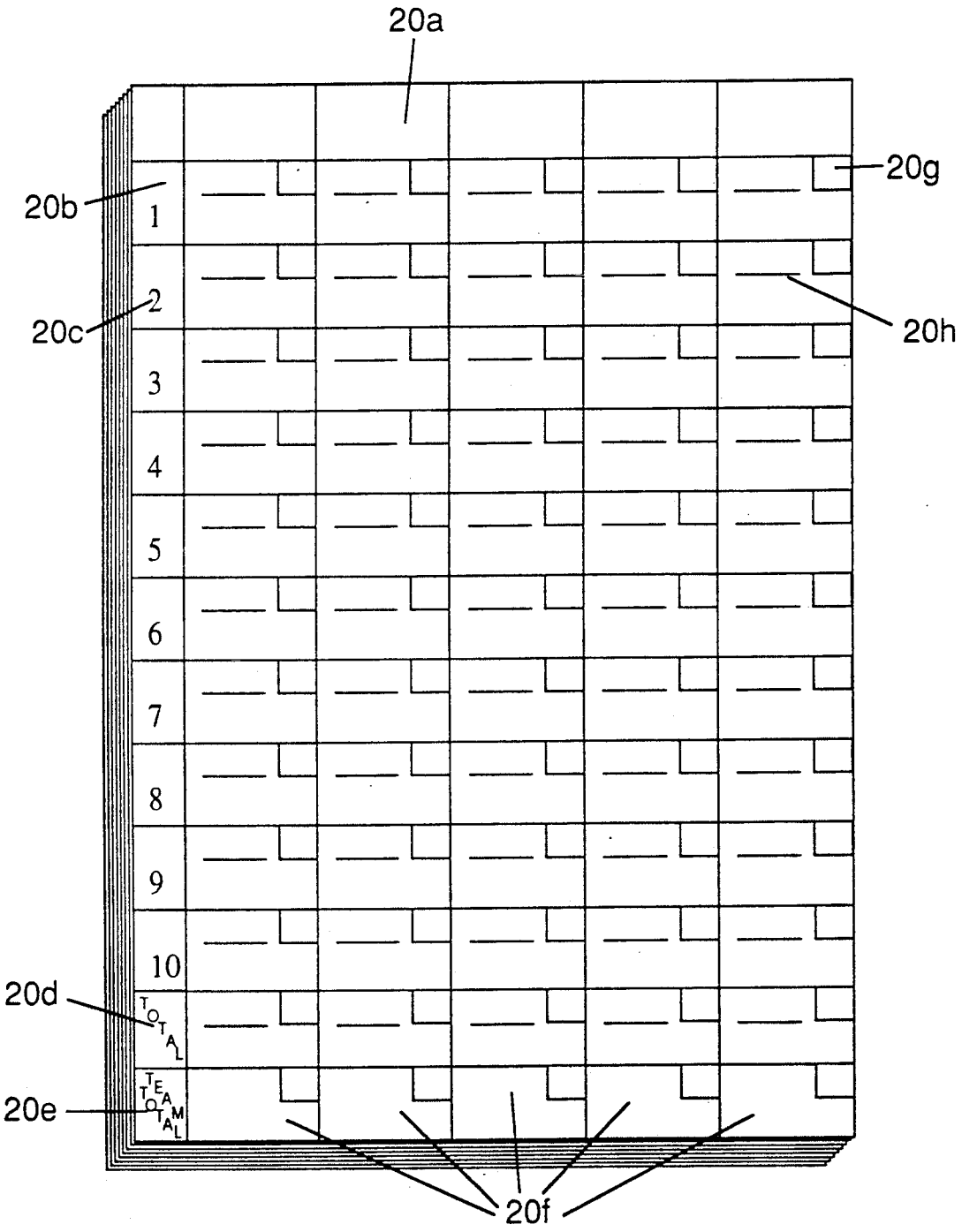
FIG. 20 is a perspective view of the scorepad forming a part of the game apparatus of the present invention.

FIG. 20 includes a horizontal row of boxes for players names indicated by 20*a*. There are five boxes for names indicated by 20*a* on scorepad 20.

A vertical row of boxes on the left side indicated by 20*b* starts immediately below 20*a*. There are twelve boxes in the vertical column 20*b*. The uppermost ten boxes starting at the top and progressing downward are numbered from 1 to 10 respective indicated by 20*c*. The eleventh box down in the vertical column 20*b* includes the word total indicated by 20*d*. The twelfth box in the vertical column 20*b* includes the words team team total indicated by the 20*e*.

Vertical lines extending downward from the sides of the name boxes 20*a* and horizontal lines extending to the right from the bottom line of the vertical boxes 20*b* intersect forming five vertical columns of boxes indicated by 20*f*, each vertical column including twelve boxes in number. Therefore there is a total of sixty boxes 20*f* included in scorepad 20.

Included in each box 20*f* is a smaller box located in the top right hand corner indicated by 20*g*. In addition the first eleven boxes in each vertical column include a short line one half of the box width, centered in the box one third of the box height from the top indicated by 20*h*.

Tokens are provided as part of the game apparatus of the present invention. FIG. 1 shows the tokens indicated by the numeral 21. There are thirty six tokens in the present invention.

CARD GAME AND RULES FOR PLAYING THE SAME

Seating is arranged such that if team play is the format players will not sit directly next to a team member, but will have an opposing team player on each side.

The dealer is chosen by random draw of a card by each player. The player with the lowest value card drawn from the deck of cards is the dealer. In case of a tie a tiebreaker draw is made by those players tied.

Scorekeeping is done by the player to the right of the dealer or a player designated by the group of players.

The deal progresses clockwise from player to player after the end of each game. Scorekeeping can either progress or remain with the designated person.

The dealer will mix the cards by whatever means is best suited to that person. A cut of the cards will be offered to the player to the dealers right after the mix of the cards.

The dealer must deal each player three cards one at a time beginning with the player on the left and progressing clockwise. The three cards are the players hand and the player is permitted to look at them. The dealer also deals each player twelve cards, dealing three at a time, this is the players box and the cards are not to be looked at unless they are played by the player that they are dealt to. If they are played then they are exposed to all players as they are played. The twelve cards making up the players box are stacked directly in front of the players seating area.

The dealer places the remainder of the cards in a single stack in the center of the playing area, this is called the deck.

The dealer gives each player three tokens which in the course of the game may be exchanged for a new hand by a process stated later in this disclosure.

In the course of play, all cards played by a player will be placed face up in front of the players box in view of all other players.

If a player deems his or her hand to be of poor quality for gaining points, the player may exchange the three cards of the hand in the following manner: At the beginning of his or her turn the player announces that they are changing hands and they place one token in the center of the playing area next to the deck. If the player does not have a token, having used all of his or her tokens previously, then the player is not allowed to make the exchange, but must continue play with the cards held in the hand. After a token is surrendered all three cards of the hand are placed in a stack next to the deck. No cards may be held back, all three must be discarded.

The players turn of play is then played to completion from the players box. When the turn of play is completed the player draws three cards from the top of the deck for a new hand.

Start of play for each game begins with the dealer and progresses clockwise until every player has completed ten turns. The scorekeeper announces the beginning of the tenth turn of play before the dealer starts to play his or her tenth turn.

Each player at his or her turn has options for making play. Play can be made from the three card hand, from the players box or by a combination of hand and box. A combination play can start by playing the first card from either the hand or box and a player does not have to disclose the choice prior to the actual play, except when making an exchange of hands.

If play is made from the hand then the number of cards used in play are replaced by drawing an equal number from the top of the deck in the center of the playing area at the end of the turn. In case of the tenth turn of play, the drawing of the replacement cards only takes place if a bonus play is required, in which case the replacement card or cards is done prior to playing any bonus card. In all cases the last card played from the hand is not replaced by drawing from the deck.

When cards are played from the players box they are not replaced from the deck. If a players box becomes depleted before the end of the game the dealer will deal a short box consisting of six cards from the top of the deck dealt face down, but the dealer will not deal a player a short box when the players box becomes depleated at the end of the tenth turn of play. If the box is depleated at the end of the tenth turn and the player is entitled to a bonus play, the player must make the bonus play from the cards in hand.

In the course of playing the game of the present invention bonus scores are acquired by: playing a card on the first card of a turn that has included on it the word strike and the symbol of a rectangle with crossed diagonal lines within it; by playing a card that has included on it the word spare and the symbol of a rectangle with a diagonal line from the upper right hand corner to the lower left hand corner, in a combination with another card when the other card does not have included on it either of the words strike or split; by playing a card that has included on it the word strike and the symbol representing the same as a second card of a two card combination when the first card played does not have on it either word spare or split; by playing a two card combination of first and second cards that equal in total to exactly ten points in number value and neither one of the cards has included on it any of the words strike, spare or split; by playing a two card combination in either order of one card having included on it the word split and the other having included on it the words made a split.

The play of a card having on it the word strike on the first card of a turn earns the player the score of ten points plus the bonus of the score for the next two cards that will be played on a subsequent turn or turns of play added to the ten points all to be totaled in the scorebox for that turn where the strike is played, therefore the scorer does not mark a number value until after the next two cards are played. The record of a strike having been played for that turn is kept by the scorer placing an X from corner to corner in the small box included in the score box for the turn where the strike was played.

When the play of a strike is made on the tenth turn the player continues the two card bonus play before passing play to the next player. If the play was made from the hand or if an exchange of hands was being made by token payment, then the draw for replacement cards is done prior to play of the first bonus card. If the first bonus card is a strike it is replaced by drawing from the deck before playing the second bonus card, but if it is not a strike play continues without drawing. There is no replacement for the final card played in any case.

When a spare is made by any of the conditions previously stated it earns the player the score of ten points plus the bonus of the score for the next card played on a subsequent turn added to the ten points, all to be totaled in the scorebox for the turn where the spare was played. Therefore the record of a spare having been played is kept by the scorer marking a diagonal line from the upper right hand corner to the lower left hand corner of the small box included in the scorebox for the turn of play where the spare was made.

When a spare is made on the tenth turn of play the player continues to play the bonus card before passing play to the next player. If play was made from the hand or if an exchange of hands was made by token payment, the draw of the replacement cards from the deck is done prior to the play of the bonus card. The final card is not replaced in any case.

A special rule for scoring applies to the final card played when a strike is played for the tenth turn and the first bonus card is also a strike. If a card with the word spare and the included symbol for the same is played as the second bonus card it will count as ten points. This same rule applies when the tenth turn has a bonus condition of spare, then if the last card played is a card with the word spare and has the included symbol for the same, it will count as ten points. As last card played is the only time that the card marked spare will count as ten points without another card following it.

When a card with the word strike and the included symbol for the same is played as the second card of a two card combination during a turn and the first card was any card other than one with the included word split or spare, then the bonus condition of spare is the only one given to the player.

When any card with the included word split is played as the first card of a turn, the only card that will earn the player a bonus condition is one marked made a split, played as the second card of that turn. The bonus condition earned is a spare. When any card other than one marked made a split is played on the second card after a split is played for the first card, the player will receive the value of the two cards totaled if the total is nine or less. If the value of the two cards totaled is ten or more, then the player will only recieve the highest value but less than ten. If the second card played is one marked with a spare or strike, the value of the card marked split is the point value received for score.

When in the course of the game a player plays two cards and neither card has on it the word or words split, spare or strike, but are cards of other values and the total for the two cards is exactly ten points, the scorer will mark the player a bonus condition of spare for that turn. When the total is more than ten points the player will be given only the point value of the highest card for that turn. When the total of the two cards is less than ten the player will be given the total count of the two cards for a score for that turn.

When any card that has the included words made a split is played and it is not in combination with any card marked split, it will be equal to the cards marked foul and gutter ball and will be treated the same for scoring purpose.

When a card with the included word spare is played as the first card of a turn and the second card of that turn has included on it any of the words split, spare or strike, then the second card must be discarded on the players playing stack in front of the players box and is ignored for play and scoring. Play continues by the player until a card that does not have any of those three included words on it is played. The card played that has a value less than spare or strike is used for scoring any bonus from a previous turn or turns of play. A card with the included word split can not be discarded from the players hand under these conditions.

In scoring play the scorer will place each players name at the top of a vertical column on the scorepad. When more than five persons are playing, more than one score-sheet will be used. If team play is the mode, then separate sheets should be used for each team. All scoring that a player makes for a turn is placed below the players name across from the turn of play where the score was made.

When a player earns a bonus then the appropriate mark is made in the small box included in the score box for that turn where the play was made.

If a bonus condition of strike is earned by playing a card 30*j* with the included work strike on the first card of a turn, an X is placed in the small box included in the scoring box for that turn of play. On the next turn of play for that player, if two cards are played the end result of the two card play in total points reverts back to the previous scorebox as a bonus and is added to the strike value of ten points. The total for the two card bonus plus the ten points for the strike is placed on the short line included in the scorebox where the strike was made. The previous accumulated score is then added to that for a new accumulated score.

If a bonus condition of spare is earned by any of the cases previously stated, a diagonal line is placed in the small box included in the scorebox where the spare was made, from the upper right to the lower left corner. On the next turn of play for that player, if a spare is played on the first card then the player must play a card of value less than ten to use as the bonus card, but not a card marked split. If a strike is played on the first card the player will receive the ten points for the strike plus ten points for the spare. If a card of other marking than spare or strike are played on the first card then the point value of that card will count as the bonus value. When bonus value is determined that value is added to the ten points for the spare and placed on the short line included in the scorebox where the spare was made. The previous accumulated score is then added to that for a new accumulated score.

When two cards are played that do not have included on any of them the words split, spare or strike and the two cards total more than ten points in value, the score of only the highest of the two values is placed on the short line in the scorebox for the turn and the previous accumulated score is added to that for a new accumulated score.

When two cards are played that do not have included on any of them the words split, spare or strike and the two cards total nine points or less in value, the total of the two cards is placed on the short line in the scorebox for the turn and the previous accumulated score is added to that for a new accumulated score.

What is claimed is:

1. A method of playing a bowling card game comprising the steps of:

(a) providing a deck of cards including a first set of cards, the cards in the first set each having a number value from zero to nine wherein the number value on each card represents points or the number of bowling pins knocked down on one roll of a bowling ball, a second set of cards, the cards in the second set each having the number value ten and the word "strike" representing a strike in bowling, a third set of cards, each card in the third set having the number value ten and the word "spare" representing a spare in bowling, a fourth set of cards, each card in the fourth set having the word "split"

representing a split in bowling, a fifth set of cards, each card in the fifth set having the words "made of split" representing making a split in bowling;

(b) providing a plurality of tokens;

(c) providing a scorecard simulating a bowling scorecard;

(d) defining the act of rolling a bowling ball and the result of the number of pins it knocks down by picking a card and revealing its face or number value to all the players, representing this step as the playing of a card;

(e) defining rules for gaining points during a player's turn by playing any one of the following options, playing a "strike" card, playing in combination a spare card and a card having a number value between zero and nine, playing in combination a first card having a number value between zero and nine and a second card having a number value between zero and nine wherein the sum of the two cards is ten or less, however if the sum of the first and second cards is greater than ten, playing only the card with the higher number value, or playing in combination a first card with the word "split" and playing a second card with the words "made a split";

(f) dealing each player a hand of three cards;

(g) dealing each player twelve cards separately from the hand of three cards, each player stacking their twelve cards face down directly in front of their seating area, representing each player's stack of twelve cards as the "players box";

(h) placing the remaining undealt cards in a single stack in the center of the playing area, representing the remaining undealt cards as "the deck";

(i) dealing each player three tokens;

(j) each player looking at their hand of cards and determining its quality for gaining points wherein a hand having three "strike" cards being the best hand for gaining points and a hand having three zero cards being the worst hand for gaining points;

(k) each player, one at a time, beginning a turn by attempting to gain the most points while following the rules of playing cards according to step (e) wherein the cards to be picked and played being limited to one of the following options, playing one or two cards from the player's hand, playing in combination a card from the player's hand and playing a card blindly picked from the player's box, playing one or two cards blindly picked from the player's box, or discarding all three cards in the hand by surrendering one of the player's tokens and playing one or two card blindly picked from the player's box;

(l) marking on the scorecard the points gained by the cards played by the player;

(m) placing the cards played or the three cards discarded in a separate stack next to the deck and replenishing the player's hand to three cards by blindly picking a card or cards from the deck;

(n) repeating steps (j) to (m) until each playing has had ten turns, the player gaining the most total points being the winner.

* * * * *